US005458502A

United States Patent [19]

Joly

[11] Patent Number: 5,458,502

[45] Date of Patent: Oct. 17, 1995

[54] IDC TERMINAL WITH BACK-UP SPRING

[75] Inventor: Jean C. Joly, Osny, France

[73] Assignee: The Whitaker Corporation, Wilmington, Del.

[21] Appl. No.: 304,326

[22] Filed: Sep. 12, 1994

[30] Foreign Application Priority Data

Oct. 27, 1993 [FR] France ..... 93 12816

[51] Int. Cl.[6] ..... H01R 4/24

[52] U.S. Cl. ..... 439/397; 439/399

[58] Field of Search ..... 439/395–399, 439/400–404, 842, 843, 847

[56] References Cited

U.S. PATENT DOCUMENTS

| | | | |
|---|---|---|---|
| 4,385,794 | 5/1983 | Lucius | 439/399 |
| 4,552,425 | 11/1985 | Billman | 439/842 |
| 4,713,026 | 12/1987 | Mobley et al. | 439/845 |
| 4,740,171 | 4/1988 | Holden et al. | 439/191 |
| 4,806,120 | 2/1989 | Baker | 439/399 |
| 4,934,965 | 6/1990 | Buddrus et al. | 439/845 |
| 5,069,635 | 12/1991 | Holden et al. | 439/400 |
| 5,112,244 | 5/1992 | Kuzuno et al. | 439/395 |
| 5,139,434 | 8/1992 | Goodman | 439/399 |
| 5,186,664 | 2/1993 | Abe | 439/845 |
| 5,226,842 | 7/1993 | Endo et al. | 439/843 |

FOREIGN PATENT DOCUMENTS

| | | | |
|---|---|---|---|
| 3731996 | 7/1988 | Germany | 439/842 |

*Primary Examiner*—Larry I. Schwartz
*Assistant Examiner*—Jill DeMello
*Attorney, Agent, or Firm*—Adrain J. LaRue; Mary K. Van Atten

[57] ABSTRACT

An IDC terminal is shown comprising a contact body and a back-up spring having an IDC back-up portion for resiliently supporting the IDC contacts. The back-up spring further has a contact spring section comprising bowed-in resilient beams supported on both ends to cavities respectively that are supported to side walls of the contact body. The contact spring section forms a top wall of the contact and provides a very high spring force onto a complementary male tab for producing high contact pressure. The IDC back-up portion comprises a central reinforcing rib for increasing the spring strength thereof, whereby positioning the IDC back-up spring within the IDC contact section, provides for a very compact design. Due to the use of a back-up spring, the contact material can be optimally chosen. Advantageously therefore, the terminal is compact yet has a high current carrying capability and is well adapted for cost-effective automated assembly.

13 Claims, 4 Drawing Sheets

IDC TERMINAL WITH BACK-UP SPRING

BACKGROUND OF THE INVENTION

1. Field of the Invention

This invention relates to an electrical terminal having an insulation displacement contact section reinforced with a back-up spring.

2. Description of the Prior Art

Insulation displacement contacts (IDC) are increasingly common in the electrical industry because they allow simultaneous termination of a plurality of terminals to respective conducting wires in a simple automated procedure whereby the wires do not need to be stripped and are simply forced into IDC slots with a stuffer tool. There is a rapidly rising demand, particularly in the automobile industry, for electrical terminals that can be assembled in an automated procedure, whilst the electrical current carrying capability, reliability, compactness and robustness are also subject to challenging requirements.

Some of the important factors determining the current carrying capability of a terminal is the conductivity of the metal from which the contact is formed, and the contact resistance between mating terminals or between the conducting wire and terminal. The latter is largely determined by the contact pressure exerted therebetween which in turn is determined by the spring forces that engage the contact surfaces together. Unfortunately, the sheet metal commonly used for producing electrical terminals usually decreases in resiliency as the conductivity and ductility increases. Additionally, there is also an increase in the creep properties i.e. stress relaxation of the material over time and as a function of temperature and stress. The latter is aggravated by the requirement to produce compact terminals having small material cross-sections engendering high resistance and therefore high temperatures during the passage of electrical current, whereby the high temperatures greatly increase the rate of creep of the metal.

It is known in the prior art to increase the contact pressure between mating terminals by providing a back-up spring made of a resilient temperature resistant material such as steel, that provides added resilient forces stable over time and at operating temperatures. One of the problems with some of these terminals with back-up springs, is that the back-up spring only participates in providing the overall contact pressure, whereby the contact body itself provides the remaining force and the contact material must therefore be sufficiently resilient which in turn decreases the conductive properties thereof. In the prior art, sufficient resiliency of the contact material is also required to provide a suitable connection between the IDC slots and the conducting wire connected thereto, in order to ensure that the contact pressure therebetween does not relax due to creep.

SUMMARY OF THE INVENTION

It is therefore an object of this invention to provide a simple and robust terminal capable of high current applications that can be connected to conducting wires in an automated procedure.

It is a further object of this invention to provide a compact and reliable terminal provided with a back-up spring for IDC contacts.

It is yet another object of this invention to provide a terminal with improved conductivity and contact pressure.

The objects of this invention have been achieved by providing an electrical terminal having a contact body comprising a contact section and a wire receiving section, the wire receiving section comprising insulation displacement contact support walls having opposed edges forming one or more slots for receiving the conducting wire, characterized in that the terminal also has a separate back-up spring attached to the support walls for resilient biasing thereof together against outward forces of the conducting wire positioned in the slots. Further objects have been achieved by providing the aforementioned terminal with a back-up spring having a contact spring portion for biasing the complementary terminal against the contact body.

DETAILED DESCRIPTION OF THE PREFERRED EMBODIMENT

Figure 1:
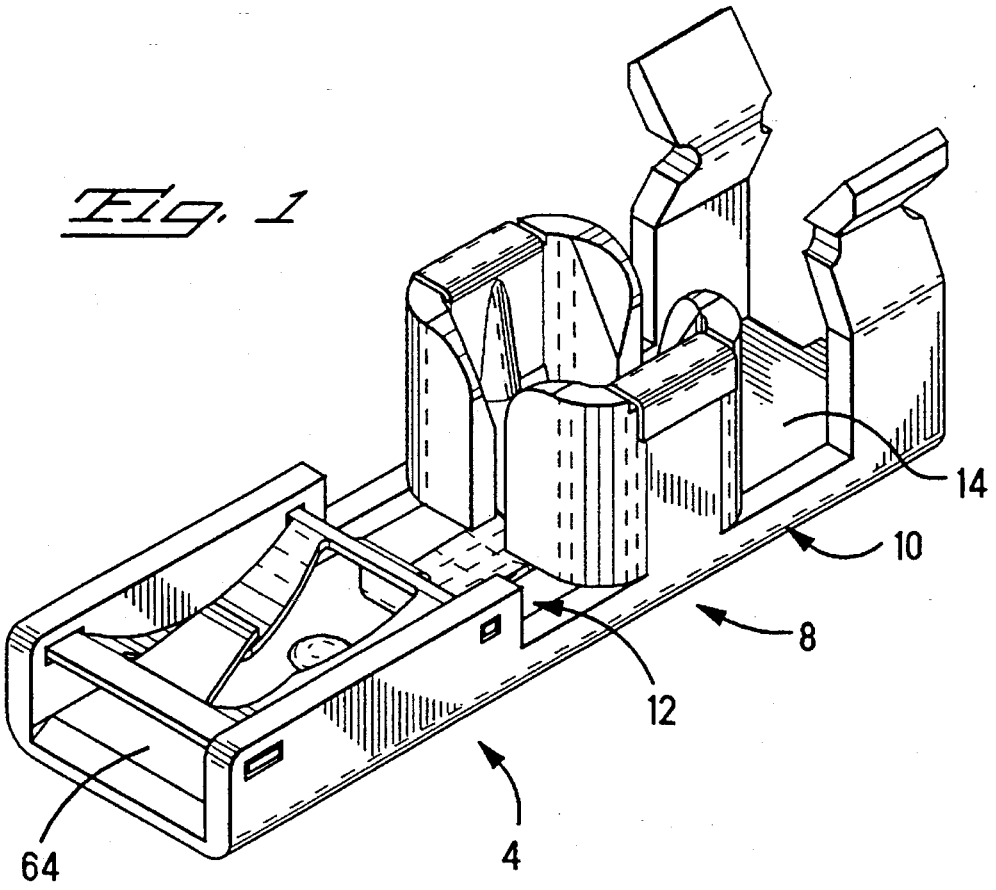
FIGS. 1 and 2 are isometric views looking respectively at the top and bottom of an electrical terminal receptacle.
Figure 2:
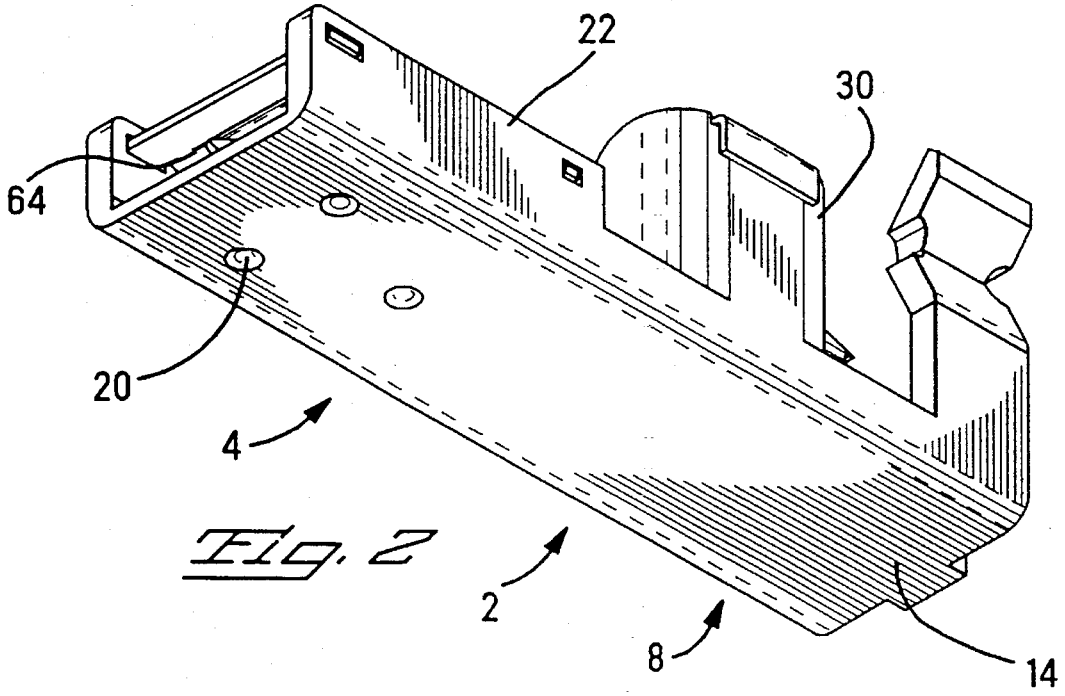
Figure 7:
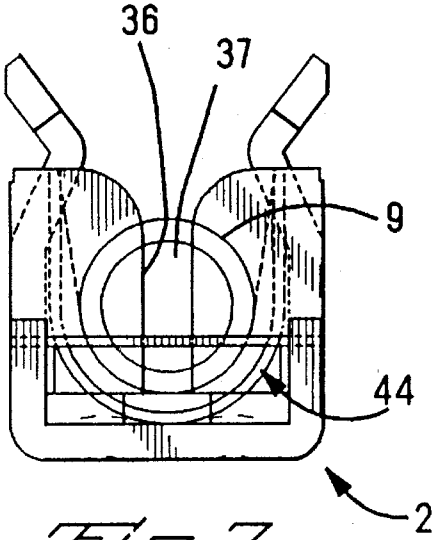

Referring to FIGS. 1 and 2, an electrical terminal 2 is shown comprising a contact section 4 for mating with a complementary male tab terminal 102, and a wire receiving portion 8 for connection to a conducting wire (shown in outline 9 in FIG. 7). The terminal 2 comprises a contact body 10 stamped and formed from conductive sheet metal, and a back-up spring 12 stamped and formed from resilient sheet metal.

Figure 3:
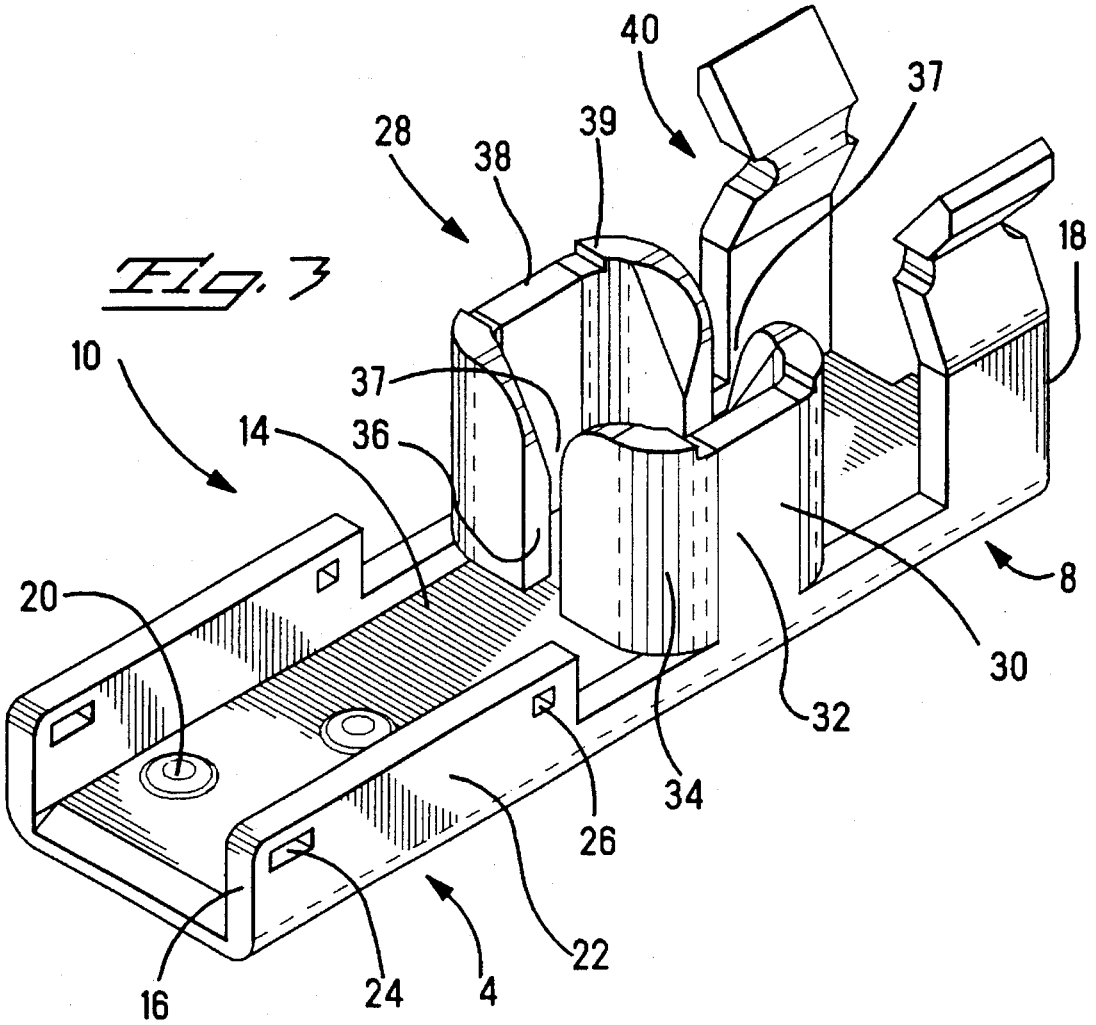
FIG. 3 is an isometric view of the terminal of FIG. 1 with the back-up spring removed.

Referring now to FIG. 3, the contact body 10 comprises a base wall 14 extending longitudinally from a mating end 16 of the terminal to a wire receiving end 18 and having in the contact section 4, embossed contact protrusions 20. The contact section 4 also comprises side walls 22 extending orthogonaly from lateral edges of the base 14 and having back-up spring forward and rear support cavities 24, 26 respectively.

In the wire receiving section 8, the contact body 10 comprises an insulation displacement contact (IDC) section 28 comprising a pair of opposed support walls 30 extending orthogonaly from the base 14 and having central portions 32 attached to lateral edges of the base 14, and arcuate wall portions 34 bent towards each other such that edges 36 thereof form a slot 37 for receiving the conducting wire therebetween. At a top edge 39 of the support walls 30 are recesses 38 for receiving mounting portions of the back-up spring. Proximate the wire receiving end 18 are deformable lateral strain relief members 40 for securely holding the conducting wire to the terminal 2.

Figure 4:
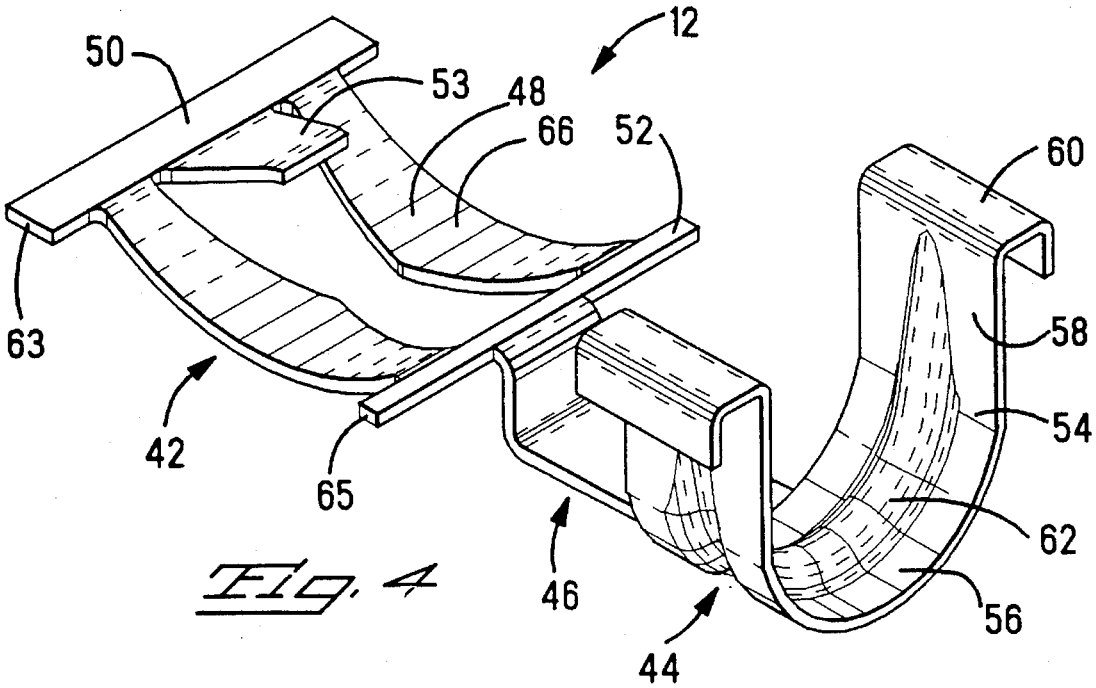
FIG. 4 is an isometric view of the back-up spring of FIG. 1 only.
Figure 5:
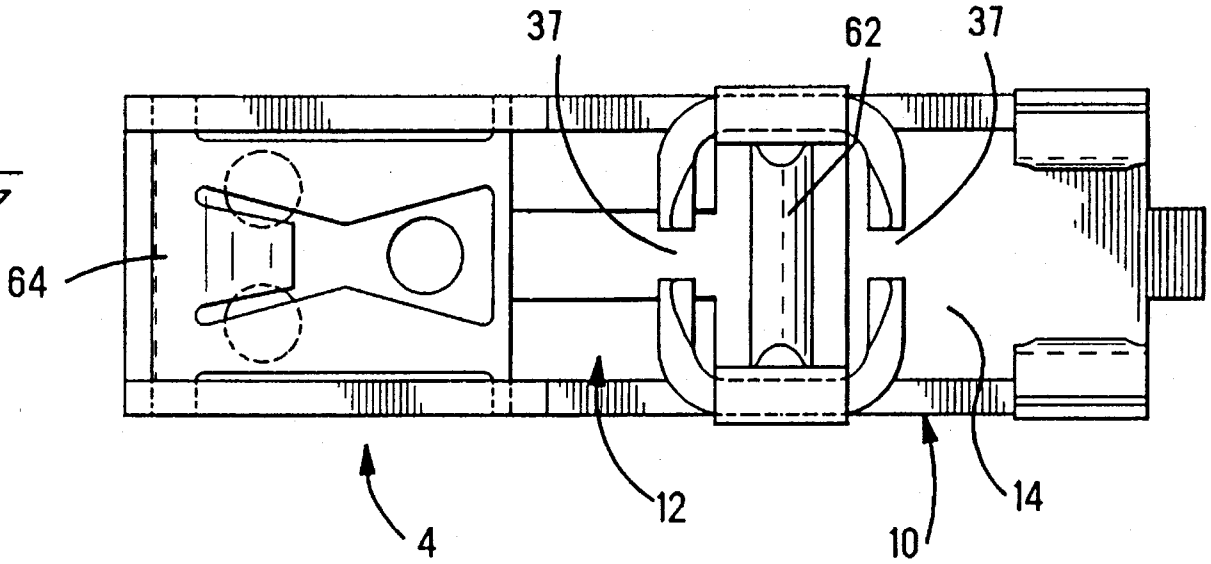
FIGS. 5 to 7 are respectively plan, cross-section side and end views of the terminal shown in FIG. 1.
Figure 6:
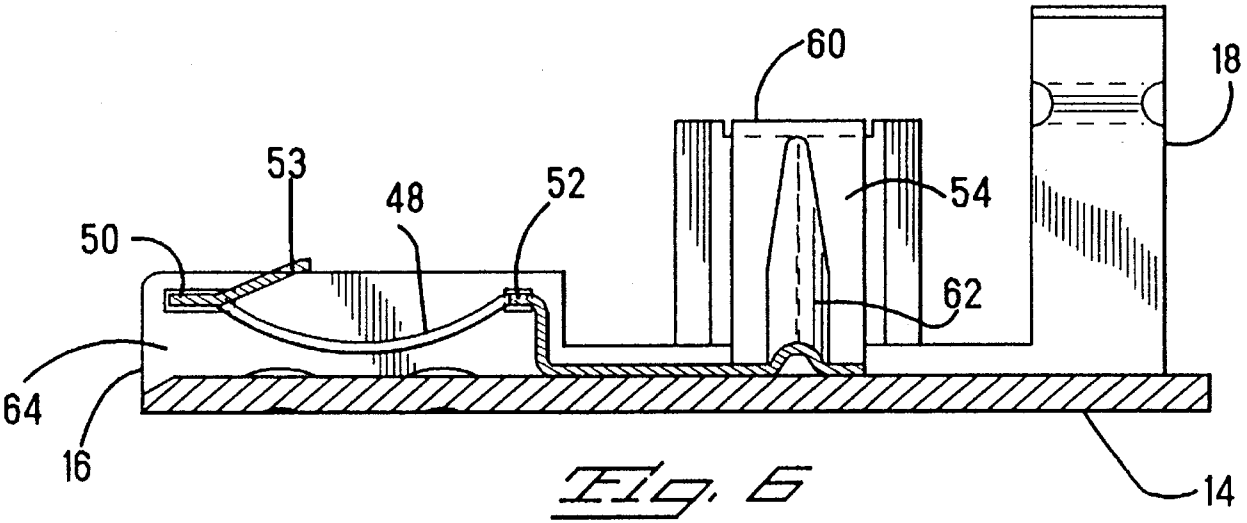

Referring now to FIG. 4, the back-up spring 12 is shown comprising a contact spring portion 42 and an IDC back-up portion 44 integral therewith via a central bridge portion 46. The contact spring portion 42 comprises a pair of resilient inwardly bowed beams 48 supported on either end to transverse support beams 50, 52, respectively that span from side wall 22 to side wall 22 of the contact body 10 when assembled thereto, finding support in the cavities 24, 26 respectively. The contact spring portion 42 further comprises a centrally and forwardly located oblique locking lance 53 for retention of the terminal 2 in a connector housing 55 (see FIG. 9). The IDC back-up portion 44 comprises a U-shaped member 54 having an arcuate base portion 56 and side walls 58 extending into bent over mounting tabs 60 at their top ends for clasping over the recesses 38 of the contact body support walls 30. Extending centrally along the U-shaped section 54, is an arcuately shaped reinforcing rib 62 for increasing the resilient strength of the U-shaped section 54. The rib 62 is disposed transversely to a portion of the conducting wire that is forced into the IDC slots 36 of the contact body 10.

Referring to FIGS. 1 to 4, the back-up spring 12 is shown assembled to the contact body 10 whereby ends 63, 65 of the support beams 50, 52 are located in the contact body cavities 24, 26 respectively, the contact spring portion 42 thereby spanning across the contact body 10. Due to the bowed resilient contact beams 48, an entry funnel 64 is formed for receiving and guiding a tab 104 of the complementary male tab terminal 102. The contact beams 48 have a widened central portion 66 that purports to evenly distribute the internal moments within the beam thereby ensuring substantially equivalent bending stresses therealong for high resiliency yet optimal flexibility and reduced risk of buckling. Supporting of the resilient beams 48 at both ends and bowing them inwards, not only provides the entry funnel 64, but also a very high spring strength thereby creating high contact pressure between the mating terminals 2, 102.

The IDC back-up portion 44 of the back-up spring 12, is positioned between the contact body support walls 30 and disposed centrally between the pair of contact slots 37, whereby the U-shaped section 54 can be slightly prestressed such that it tends to pull the contact body support walls 30 together in opposition to outward forces of a conducting wire urged in the IDC slots 37. The reinforcing rib 62 further enhances the spring strength of the IDC back-up portion 44 such that it is sufficiently strong to ensure that the IDC contact edges 36 are always biased towards each other with sufficient pressure against the conducting wire, even after operating temperatures and stresses cause relaxation of the contact body material.

The contact body material can therefore be chosen for optimal conductivity and the back-up spring 12 with optimal spring properties such that the contact body 10 can support very high currents, yet have IDC contacts ideally adapted for cost-effective, automated assembly in connector housings and connection to conducting wires. Disposition of the IDC back-up portion 44 between the supporting walls 30 of the contact body further increases the compactness of the terminal, and also facilitates the assembly procedure of the back-up spring as both the contact spring portions 42 and IDC back-up portions 44 are assembled from the top of the contact body (as opposed to being wrapped around). Use of the contact spring portion 42 as a top wall that provides high spring forces not only leads to a very compact disposition, but also ensures reliable high contact pressure between the contact protrusions 20 and the complementary male tab 104.

Figure 8:
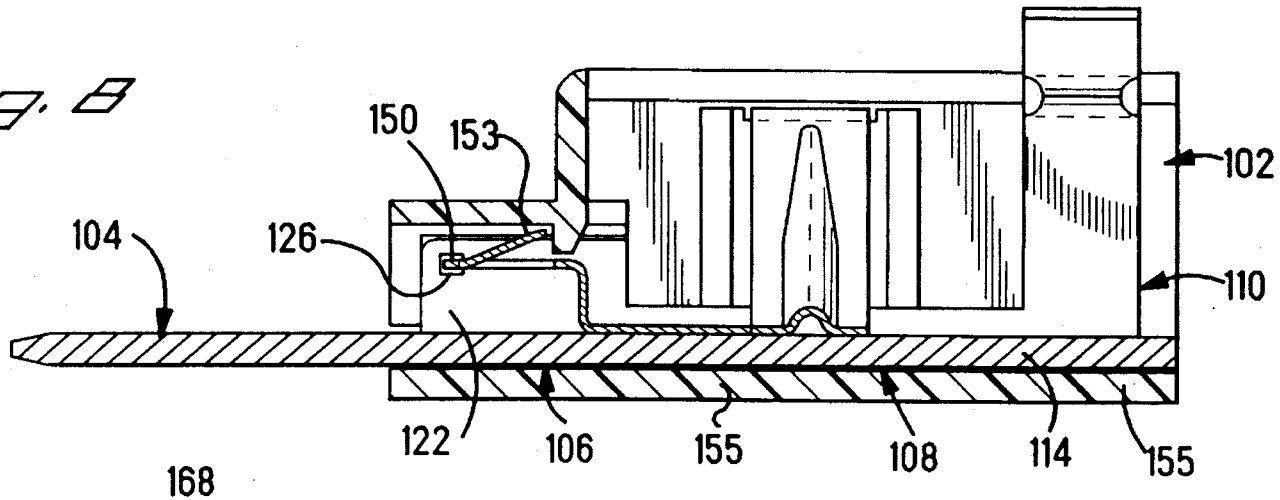
FIG. 8 is a side cross-sectional view of a complementary male tab terminal matable with the terminal of FIGS. 1 to 7.

Referring to FIG. 8, a complementary male terminal 102 matable with the receptacle terminal 2, is shown comprising a male tab 104, a retention section 106 and a wire receiving section 108 that is identical to the wire receiving section 8 of the receptacle terminal 2 and shall therefore not be further described. The complementary male terminal 102 also comprises a contact body 110 having a base wall 114 from which the tab 104 extends. The retention section 106 comprises side walls 122 extending from lateral edges of the base wall 114 and having cavities 126 therethrough for supporting a support beam 150 having a resilient locking lance 153 extending therefrom for retaining the terminal 102 within a connector housing 155.

Figure 9:
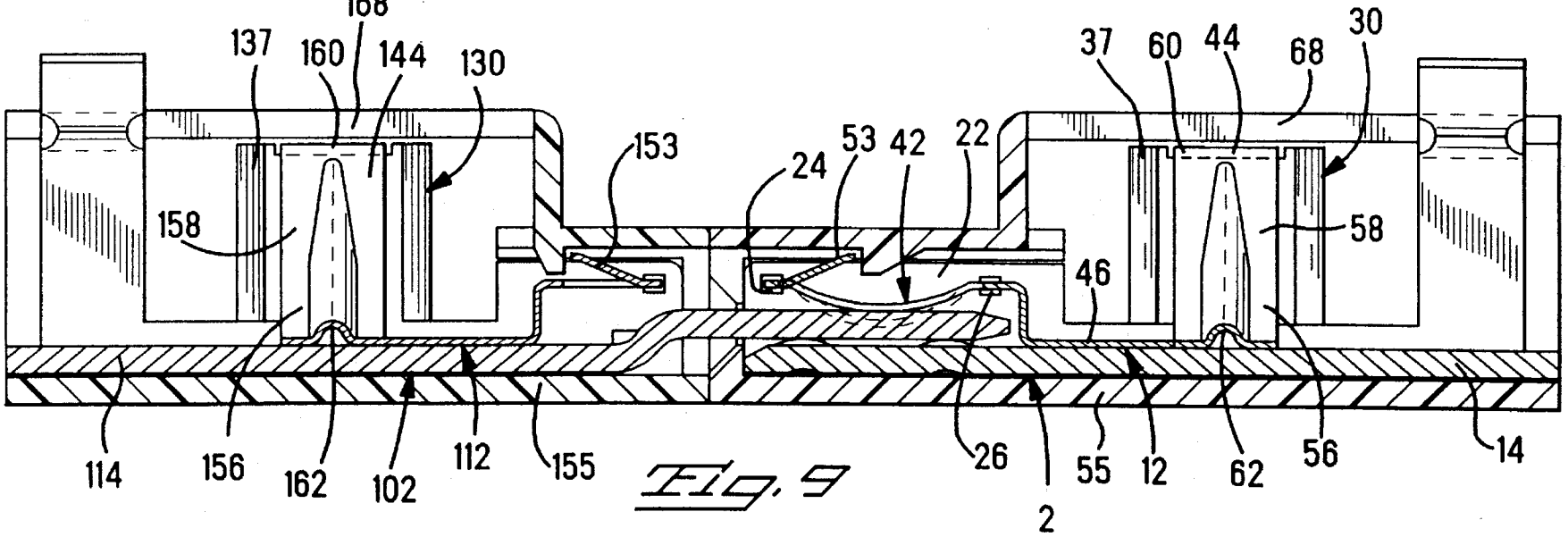
FIG. 9 is a cross-sectional side view of the male and female terminals mounted in corresponding connector housings and mated together.

Referring now to FIG. 9, the receptacle terminal 2 and complementary male terminal 102 are shown assembled in their respective connector housings 55, 155 and mated together. The housings 55, 155 have slots 68, 168 allowing access for the conducting wire to be positioned over and aligned with the pair of IDC slots 37, and subsequently stuffed therebetween with a stuffer tool adapted therefor in an automated procedure. The latter therefore allows the terminals 2, 102 to be assembled to the connector housings 55, 155 prior to assembly with the conducting wires, and then at a later stage feeding and stuffing the wires into the IDC contacts without stripping the ends. The assembly procedure can therefore be fully automated.

Advantageously therefore, the terminal is compact yet able to carry high currents and is furthermore adapted to cost-effective automated assembly harness procedures.

I claim:

1. An electrical terminal comprising a contact body for electrical connection between a conducting wire and a complementary terminal, the contact body comprising a contact section having a base, and a wire receiving section, the wire receiving section comprising insulation displacement contact (IDC) support walls having opposed edges forming one or more slots therebetween for receiving the conducting wire, characterized in that the terminal also comprises a separate back-up spring securely fixed to the contact body and having an IDC back-up portion positioned between the support walls and attached thereto for resiliently biasing the support walls together against outward forces of the conducting wire inserted in the slots.

2. The terminal of claim 1 characterized in that the terminal is a receptacle terminal whereby the back-up spring comprises a contact spring portion for biasing the complementary terminal against the contact body.

3. The terminal of claim 2 characterized in that the contact spring portion comprises one or more resilient beams disposed roughly parallel to the mating direction of the complementary terminal.

4. The terminal of claim 3 characterized in that the one or more resilient beams are attached at each end to respective support beams, whereby the support beams are fixed to the contact body.

5. The terminal of claim 4 characterized in that the resilient beams are bowed towards the contact base such that they form a funnel therebetween for receiving and guiding a male tab of the complementary terminal.

6. The terminal of any one of claims 2–5 characterized in that the contact spring portion and IDC back-up portion are integral.

7. The terminal of any one of claims 2–5 characterized in that the contact section comprises the base and lateral sidewalls extending substantially orthogonally therefrom, whereby the contact spring portion forms substantially a top wall spanning between the side walls spaced and opposed to the base.

8. The terminal of any one of claims 2–5 characterized in that the resilient beams have widened central portions for improving the bending stress distribution therealong.

9. The terminal of claim 1 characterized in that the terminal is a male tab terminal whereby the back-up spring comprises a retention section having a resilient locking lance for retaining the terminal within a connector housing.

10. The terminal of claim 9 characterized in that the retention section comprises a support beam spanning across the contact base and fixed to lateral sidewalls thereof for securely positioning and holding the locking lance to the terminal.

11. The terminal of any one of claims 1–5, 9 or 10, characterized in that the wire receiving section comprises a pair of spaced apart and aligned IDC slots, whereby the IDC back-up portion of the spring is positioned therebetween.

12. The terminal of any one of claims 1–5, 9 or 10, characterized in that the IDC back-up portion has at least one strengthening rib disposed transversely of a portion of conducting wire received by the wire receiving section.

13. The terminal of any one of claims 1–5, 9 or 10 characterized in that the IDC back-up portion is U-shaped comprising an arcuate base portion positioned proximate the contact base, and side walls extending therefrom attached at free upper ends thereof to the support walls.

* * * * *